US005273058A

United States Patent [19]

Edwards

[11] Patent Number: 5,273,058

[45] Date of Patent: Dec. 28, 1993

[54] HAIR CURLING TOOL

[76] Inventor: Syd Edwards, 1225 Windsor Rd., Cardiff, Calif. 92007

[21] Appl. No.: 959,353

[22] Filed: Oct. 13, 1992

Related U.S. Application Data

[63] Continuation-in-part of Ser. No. 821,625, Jan. 16, 1992, abandoned.

[51] Int. Cl.[5] ..... A45D 24/10

[52] U.S. Cl. ..... 132/123; 132/119

[58] Field of Search ..... 132/119, 121, 122, 123, 132/143

[56] References Cited

U.S. PATENT DOCUMENTS

| | | | |
|---|---|---|---|
| 2,156,256 | 4/1939 | Schlicker | 132/123 |
| 2,163,524 | 6/1939 | Arpin | 132/123 |
| 2,245,054 | 6/1941 | Schlicker | 132/123 |
| 2,245,055 | 6/1941 | Schlicker | 132/123 |
| 2,672,876 | 3/1954 | Bedwell | 132/123 |
| 3,148,685 | 9/1964 | Haynes et al. | 132/123 |
| 3,381,693 | 5/1968 | Stevens | 132/123 |
| 3,974,841 | 8/1976 | Weisman | 132/123 |
| 4,049,008 | 9/1977 | Brothers et al. | 132/123 |
| 4,574,416 | 3/1986 | Stewart et al. | 132/119 |
| 4,977,909 | 12/1990 | Chou | 132/123 |

FOREIGN PATENT DOCUMENTS

| | | | |
|---|---|---|---|
| 518155 | 2/1940 | United Kingdom | 132/123 |
| 526631 | 9/1940 | United Kingdom | 132/123 |
| 526632 | 9/1940 | United Kingdom | 132/123 |

*Primary Examiner*—Gene Mancene
*Assistant Examiner*—Frank A. LaViola
*Attorney, Agent, or Firm*—John J. Murphey

[57] ABSTRACT

A hair curling and styling tool including a shaft having first and second ends, a handle member extending inward from the first end, a hair curling member extending inward from the second end toward the handle portion, a hair brush carried in the shaft of the hair curling member, for aiding the curling of hair thereabout as the tool is rotated by the handle, apparatus for moving the hair brush from an operative position exterior the shaft to an inoperative position interior the shaft to withdraw the bristles from the curl formed about the hair curling member, and apparatus for temporarily mounting a hair fastener at the shaft second end, the hair fastener including first and second shanks of terminal length, the first shank including a straight portion and a second shank, having formed therein at least one sinusoidal curve, the shanks held together by a U-shaped connecting section, and an offset portion formed in the second shank, the holding device including apparatus for positioning the offset portion of the fastener such that the straight shank is aligned parallel to the shaft and slightly above the surface of the hair curling member for movement over a segment of the curl, formed about the hair curling member, parallel and adjacent to the scalp for placement out of sight in the hair style.

20 Claims, 2 Drawing Sheets

HAIR CURLING TOOL

BACKGROUND OF THE INVENTION

Reference to Other Patent Applications

This is a continuation-in-part (CIP) of my previously filed application titled "RETRACTABLE TOOTH STYLING BRUSH", Ser. No. 07/821,625 filed Jan. 16, 1992, now abandoned.

FIELD OF THE INVENTION

This invention pertains to the field of hair styling tools. More particularly, it pertains to a tool for use where the stylist desires to form a lasting curl and affix the curl with a hair fastener that will remain in the style and out of sight.

DESCRIPTION OF THE PRIOR ART

In the art of hair styling, curling hair is quite common and popular. Through the years, thousands of hair stylists have spent countless hours forming clients' tresses into wavy or curly styles. Many styles have come and gone and many more are awaiting to be created. One of the limiting factors in creating different hair styles are the tools available to form the hair stylists' artistic creations. Limitations exist because of the stylists' inability to form a specific type of curl and/or if formed, the inability to retain the style without having the hair fasteners remaining visible to the eye. Accordingly, a tool that would quickly form a lasting curl or hair pattern leaving the pattern undisturbed, fastened by a hair fastener in one motion, and where the hair fastener would remain out of sight is highly desirable as it saves time, produces a more consistent results, allows a wider range of styles to be formed, and is much simpler to use than the conventional tools existing in the prior art.

The prior art teaches the hair stylist to make curls by multiple steps including use of chemical processes, curling hair about a heated shaft, and curling hair about cylindrical elements that are allowed to remain in the hair for several hours. These are tedious and time-consuming steps leaving inconsistent and undesirable results. Of late, there have been several patents issued concerning hair curling tools that attempt to refine hair styling by teaching the use of a tool having a cylindrical curling portion including a retractable comb member.

For instance, U.S. Pat. Nos. 2,672,876; 3,148,685; 3,381,693 and 3,974,841 concern hair curling tools for curling hair, comprising an elongated shaft having a comb member wherein said comb is used to comb the hair, the hair is curled by rotating the comb member, the comb member is then retracted from the hair into the shaft and the shaft is withdrawn by the operator to remove the tool without disturbing the formed curls. While such tools are useful, they require the stylists to affix the curl with a hair fastener which remains visible to the eye.

Additionally, hair dressing tools described in U.S. Pat. Nos. 2,245,054 and 2,163,524 and British Patent 518,155 and 526,632 describe tools capable of curling hair, retracting the comb member, and at the same time affixing a hair fastener to the curl. However, in these tools, the free or outer shank of the hair fastener is positioned at an angle to the curling tool. Withdrawal of the curler with the fastener attached must be above the mass of the hair or curl because to attempt to affix the hair fastener adjacent the scalp would cause the free end of the fastener to dig into the person's head causing scalp damage, skull irritation, and subject the skull to constant pressure of the fasteners' curved ends thereby causing discomfort and headaches. U.S. Pat. No. 4,574,416 teaches a brush with retractable bristles, however, it does not teach the curling of the hair but limits its purpose to having a brush whereby the retraction of the bristles allows the user to remove the excess hair left over on the brush after use. U.S. Pat. No. 4,977,909 teaches a brush with retractable bristles with means for connecting a water flow to and through the brush bristles, however, it does not teach curling hair and fastening the curl in a one-step process.

Accordingly, while the prior art teaches the use of hair curling tools having a retractable comb or brush member and in some cases attaching a hair fastener to the end of the tool such that the hair fastener would slide over and clasp the curl upon withdraw of the member from the curl, it does not teach how to accomplish the same task in a smooth operation and in a single motion, nor can it be done without causing discomfort to the client. In addition, the prior art does not teach how the hair curling tool may be removed from the curl and the hair fastener moved into position on the curl co-planar and parallel to the person's scalp and where it will remain out of sight while the particular hairstyle is in existence.

SUMMARY OF THE INVENTION

This invention solves the aforementioned problems of the prior art. It comprises a tool that allows the hair stylist to roll the hair into a tight and lasting curl about a shaft having a brush extending therefrom for retaining the hair therein during the curling operation. The brush is retractable into the curling member to allow the curling member to be withdrawn without disturbing the formed curl. Thereafter the tool may be withdrawn from the curl and the same single-handed motion that withdraws the tool, affixes a hair fastener to the curl at any place on the curl but especially between the curl and the scalp to position the hair fastener parallel and flushed against the scalp and out of sight. This allows the hair stylist to be much more creative and will allow him or her to create many more hair styles in a shorter period of time with more consistency and quality. This is so because the stylist is able to make a curl without unraveling it to remove the curling tool from the hair. Furthermore, in the same motion of withdrawing the tool, the stylist may choose to affix the curl in its position by securing it with a special fastener that may be moved in place over the curl at any point about the circumference of the curl, even underneath the curl to remain out of sight.

This invention comprises an elongated shaft having a handle portion extending from one end inward and a curling member portion beginning at the opposite end extending inward toward the handle for curling the hair thereabout. The shaft contains a brush positioned under the curling member and attached to a spring means to bias it outward into operable position above the member. A trigger is provided for moving the brush from the operative position to an inoperative position within the shaft. The brush bristles have uneven lengths, are arranged in a staggered pattern and have flat ends for aiding in securely gripping and combing the hair while reducing irritation to the scalp. The hair curling member has an oval cross-section to allow a tighter curl to be formed thereabout while simultaneously providing additional space for greater bristle length to aid in grasping the hair. A short conically shaped organizer extends outward from the handle for use in dividing the hair into various sized sections for ease in making the curls. A guard member is slidingly received over the shaft between the handle and the hair curling member for use in urging the formed curl off of its position about the hair curling member to overcome frictional contact or minor adhesion caused by hair, wetted with various lotions, being tightly wrapped about the hair curling member. A special hair fastener is provided for temporary placement at the end of the hair curling member and held there in a special position so that it may be affixed to the curl to hold the curl and style in place while remaining invisible to the eye. A special hair fastener holder is provided to temporarily retain the special hair fastener on the hair curling member. The hair curling member contains a special finish to reduce sticking of the hair by static electricity or lotion adhesion. The device is made of fiber filled polymeric materials by injection molding that resist heat, are low cost and provide a durable styling tool.

Accordingly, the main object of this invention is a hair styling tool containing a retractable hair brush for use in forming curls thereabout and positioning a special hair fastener to the curl at various positions thereabout and especially out of sight and adjacent the scalp. Other objects of the invention include a hair styling tool having an oval cross-section to allow tighter formation of curls while simultaneously maximizing the length of the brush bristles; bristles having an uneven length and a staggered pattern in addition to having flat ends formed thereon for increasing the friction between the brush and the hair to aid the formation of the curl and simultaneously reduce the irritation to the scalp caused by contact between the bristles and the scalp; a hair styling tool containing an organizer extending a short distance from the handle for ease in separating the tresses into manageable size sections for curling about the hair curling member; a hair styling tool containing a guard slidingly mounted between the handle and the hair curling member for use in urging the finished curl from the hair curling member to overcome static electricity or liquid-caused temporary adhesion between the hair and the surface of the hair curling member; a hair styling tool including a specialized hair fastener conveniently and temporarily mounted at the end of the hair curling member for rapid and efficient attachment over the curl in a variety of locations thereabout and especially between the established curl and the scalp so as to remain hidden from view to stabilize the hair style following its formation; and a hair styling tool containing a specialized finish to reduce frictional or liquid-based adhesion between the hair curled about the hair curling member, that is made of heat resistent materials by low cost injection mold technique to produce a modern, efficient and highly useful hair styling tool.

These and other objects of the invention will become more apparent upon reading the Description of the Preferred Embodiment along with the drawings attached hereto. The property rights claimed by the inventor within the scope of the monopoly granted under the United States Patent Laws may be gleaned from a fair reading of the claims that conclude this specification.

DESCRIPTION OF THE PREFERRED EMBODIMENT

Figures 1, 2, 3, 4A, 4B:
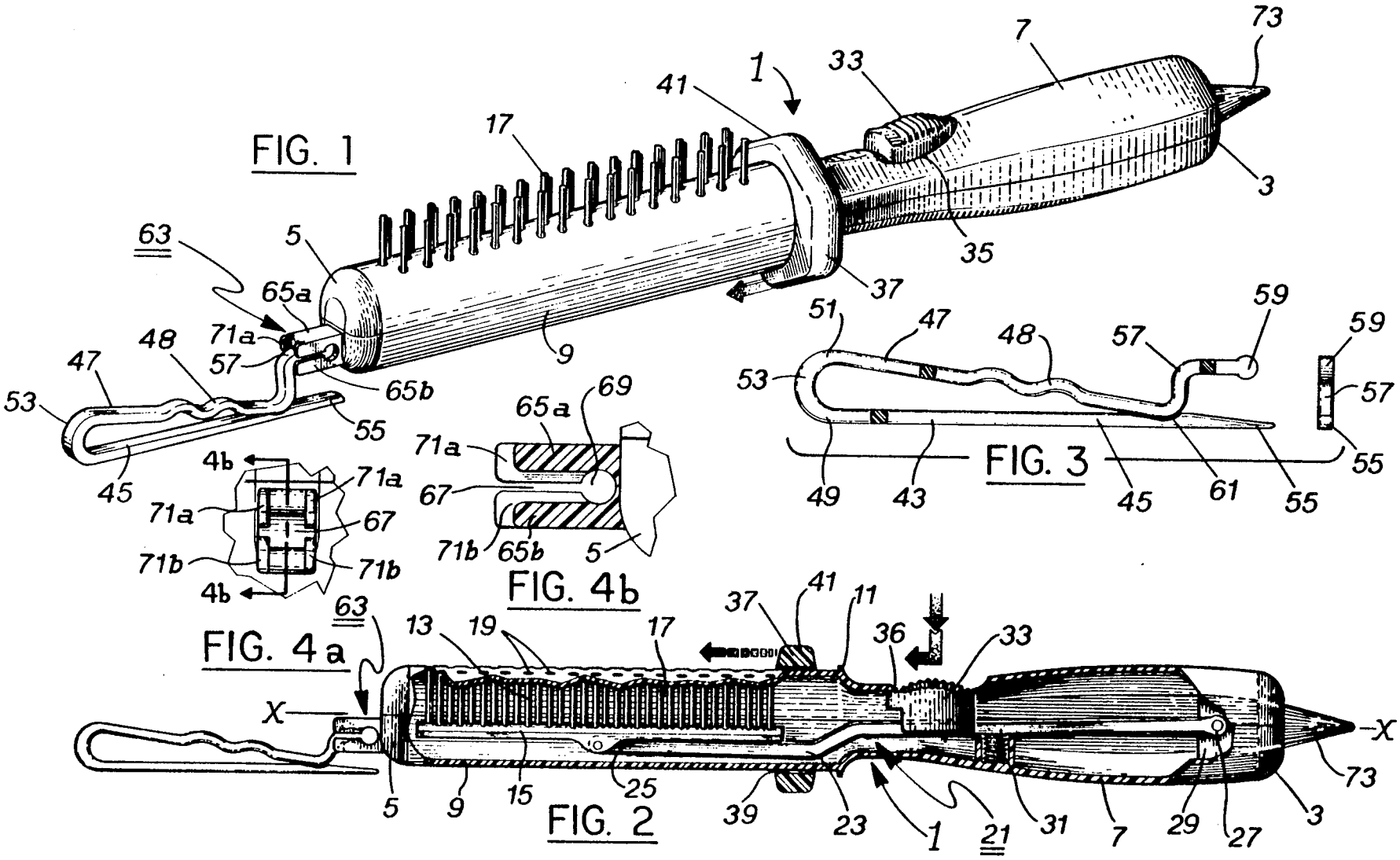
FIG. 1 is a trimetric view, partially in section, of the entire tool including the unique hair fastener and the sliding guard.
FIG. 2 is a side view, partially cut away and in section, of the embodiment shown in FIG. 1 further showing the components thereof that are mounted inside the tool.
FIG. 3 is a side plan view, partially in section, of the unique hair fastener of this invention.
FIGS. 4*a* and 4*b* are closeup views of the hair fastener holder portion of the tool; and, FIGS. 5 through 8 are portrait views of the tool being used to form a "French" twist wherein the hair fastener remains in the curl and out of view.

Turning now to the drawings, where like elements are identified with like numerals throughout the nine figures, the preferred embodiment of this invention is shown in FIGS. 1 and 2 to comprise a shaft 1 generally straight and hollow and terminated by first and second ends 3 and 5, respectively. A handle member or portion 7 extends from first end 3 inward and is preferably hexagonal in cross-section to facilitate manipulation about the longitudinal axis x—x as will be more fully explained hereinafter.

A hair curling member or portion 9 extends inward from shaft second end 5 toward handle 7 terminating at an outwardly extending circumferential ridge 11 that separates the two members. A hair brush 13 is provided and housed inside hair curling portion 9 of hollow shaft 1 and comprises an elongated brush base 15 and a series or plurality of straight brush bristles 17 extending upward from base 15. A series of holes or apertures 19 are formed in curling member 9, on the upward side thereof, in the same pattern as bristles 17 to provide passageways through which bristles 17 may pass.

Means 21 is provided in shaft 1 to bias brush 13 in an upward position whereby bristles 17 extend through holes 19, as shown in FIG. 1, to reside in an operative position above hair curling member 9. Means 21 includes an arm 23 of terminal length, located interior shaft 1, and pivotally attached at one end 25 to brush base 15 and at its other end 27 to a wall 29 formed inside handle 7. A spring 31 is provided to bias arm 23 upward forcing bristles 17 to extend through holes 19. A trigger 33 is provided in an opening 35, in handle 7, for bearing against the top of arm 23. As shown in FIG. 2, pressing downward on trigger 33 forces arm 23 downward in shaft 1 and withdrawing bristles 17 into an inoperative position inside hair curling member 9 and out of contact with hair wrapped therearound. Trigger 33 is slidably mounted on arm 23 to allow a dog 36 extending forward from trigger 33 to be moved forward under handle wall 39 to retain brush 13 in its inoperative position under curling member 9.

It is preferred that hair curling member 9 have an elliptical cross-section as shown in FIG. 1 so that the hair may be tightly curled about member 9 while simultaneously permitting bristles 17 to be as long as possible to aid in curling large amounts of hair. Bristles 17 are arranged in a staggered pattern, preferably in three rows aligned parallel to shaft axis x—x, and further be of uniform diameter along their entire lengths and terminated at the top end by a flat surface, perpendicular or normal to the axis of the bristle, with its circumferential crown or terminal edge slightly rounded. The uniform bristle diameter operates with the staggered bristle pattern to provide substantial benefits in curling the hair; the uniform diameter resists hair from migrating upward along the bristles and the staggered pattern increases friction against the hair for making tighter curls. The flat bristle ends reduce irritation to the scalp when the hair is brushed.

A guard in the preferred form of a donut-shaped member 37 is slidingly mounted on hair curling member 9 against ridge 11 and includes an inner surface 39, having a contour similar to that of member 9 and slightly larger in size so as to freely slide over member 9 and off second end 5, and an outer perimeter 41 larger than inner surface 39. While perimeter 41 may take on a variety of forms, such as circular, it is preferred that it have a polygonal shape, preferably hexagonal to prevent the tool from rolling off a table or other level surface when placed thereon. As shown in FIG. 2, guard 37 is slid forward on member 9 to aid in withdrawing member 9 from a curl of hair formed thereabout.

A special hair fastener 43 is provided with which to hold the established curl in place. Fastener 43 is shown in FIG. 3 to comprise a pair of first and second shanks 45 and 47, respectively, joined together at a common end 49 and 51 of each shank by a U-shaped section 53 so that they are held in close alignment. First shank 45 is straight and extends from its interconnective end with U-shaped section 53 to a pointed end 55. Second shank 47 contains at least one sinusoidal curve or Marcel wave 48 and an offset portion 57 bending outward from first shank 45 and terminating in a bulbular fitting 59. A slight depression 61 is formed in first shank 45 to receive therein the close portion of section shank 47 to allow further bias tension, created by the overbend of U-shaped section 53, and provide closing spring tension to first and second shanks 45 and 47, respectively.

Means 63 is provided on second shaft end 5 for temporarily mounting hair fastener 43 in facing relationship with tool 1 such that first shank 45 is aligned parallel to shaft 1 and slightly above curling member wall or surface 29 so that, as member 9 is withdrawn from a curl formed thereabout, fastener 43 is slipped over a segment of said curl where first shank 45 comes to rest parallel to the scalp. Should fastener 43 be moved over a segment of a curl adjacent the scalp, then fastener 43 will wind up between the curl and the scalp with first straight shank 45 flush with the scalp, parallel thereto, and out of sight. In this location straight shank 45 will not bear against the scalp and thus may remain there for an extended period to hold the hair style intact.

As shown in FIGS. 4*a* and 4*b*, means 63 comprises a pair of upper and lower walls 65*a* and 65*b*, respectively, extending from shaft second end 5 outwardly parallel to shaft axis x—x and separated by a slot 67 formed therebetween, of a thickness equal to or slightly less than, i.e., a few thousandths of an inch, the thickness of said first shank 45 as shown in FIG. 3. A cavity 69 is formed at the base of slot 67 for springing receipt therein of hair fastener bulbous fitting 59. To stabilize hair fastener 43 in means 63, a pair of side walls 71*a* and 71*b* extend beyond walls 65*a* and 65*b* and inward into slot 67 and are spaced apart a width corresponding to the width of second shank 47 as shown in FIG. 3. Side walls 71*a* and 71*b* engage the outside walls of second shank 47 to hold fastener 43 in alignment in slot 67.

A short conical hair separator 73 extends outward from shaft first end 3, behind handle 7, for use in inserting into a mass of hair to separate the hair into segments for curling about member 9 or for other reasons. Tool shaft 1 is preferably formed by injection molding in halves that may be later glued or otherwise joined together to form the tool. It is preferred to construct shaft 1 and the other components of light weight fiber-filled polymeric resin for high strength, low cost, heat resistance and long wearing.

Figure 5:
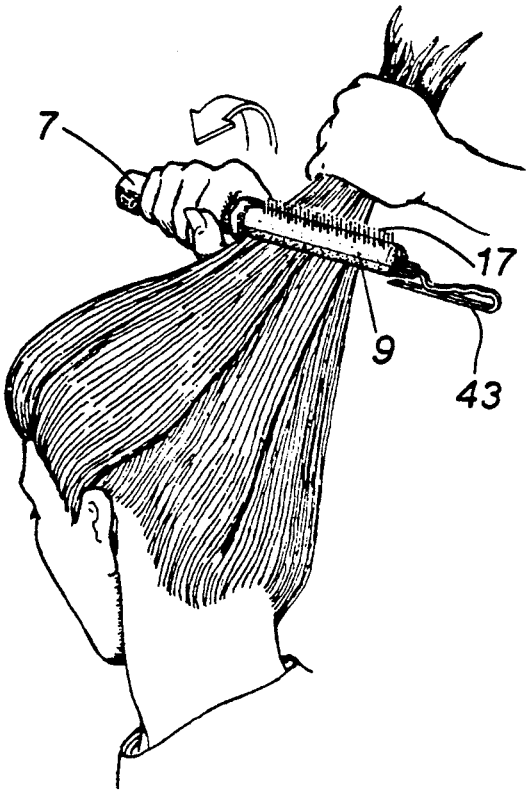
Figure 6:
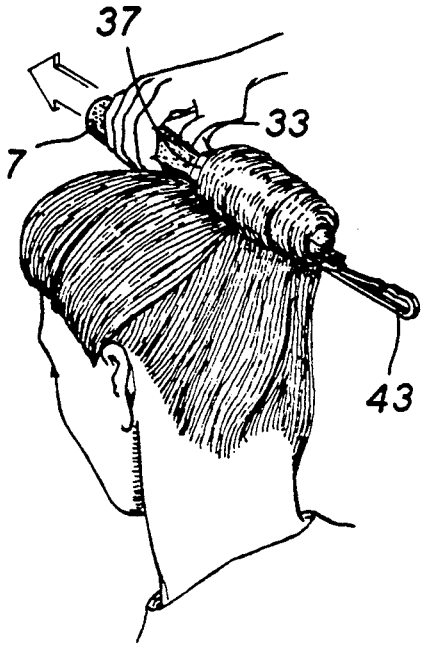
Figure 7:
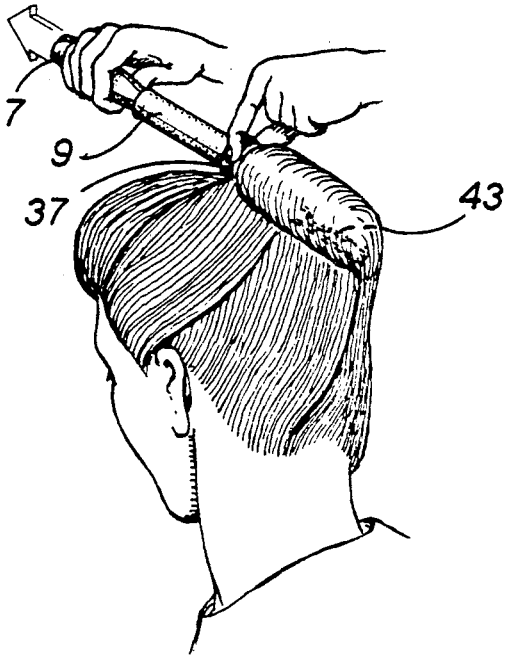
Figure 8:
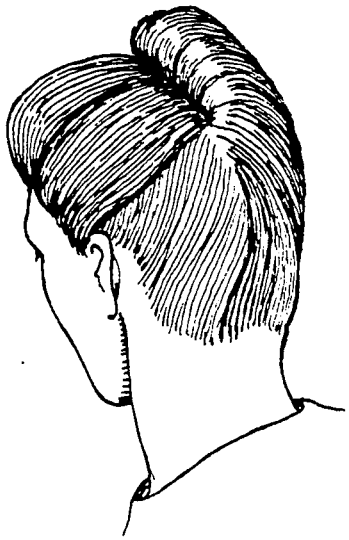

Shown in FIGS. 5 through 8 is the use of the tool to form a "French" twist type hair style where a large curl is the center of the style. As shown in FIG. 5 the hair is pulled upward in a single mass and wrapped about hair curling member 9 with hairbrush 13 in its operable position. In FIG. 6 the curl is made larger by rotating handle 7 and simultaneously advancing the tool toward the head. FIG. 7 shows the stylist thereafter pressing trigger 33 with the thumb to depress brush 13, extracting the tool from the hair by pulling handle 7 outward toward the front of the hair mass in the direction of the arrow. The finger and thumb of the opposite hand are used to guide guard 37 off curling member 9 to help extract the tool. While the tool is being extracted, hair fastener 43, mounted in means 63, slides forward with the tool to take up a position at the bottom of the curl (as shown in dotted outline in FIG. 7) to stabilize the style as shown in FIG. 8. Thereafter hair fastener 43 disengages from means 63 with a slight pull. In this style, hair fastener 43 is positioned at the base of the curl out of sight and flush against the scalp.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A hair curling and styling tool comprising:

a) a straight shaft having first and second ends;

b) a handle member portion extending inward from said first end;

c) a hair curling member extending inward from said second end toward said handle member portion;

d) a hair brush including bristles carried in said shaft of said hair curling member, for aiding the curling of hair thereabout as said tool is rotated by said handle member;

e) means for moving said hair brush from an operative position exterior said shaft to an inoperative position interior said shaft to withdraw said bristles from the curl formed about said hair curling member; and, f) holding means for temporarily mounting a hair fastener at said shaft second end, said hair fastener including first and second shanks of terminal length, said first shank including a straight portion, said second shank having formed therein at least one sinusoidal curve, said shanks held together by a U-shaped connecting section, and an offset portion formed in said second shank, said holding means including means for positioning said offset portion of said fastener such that said first shank is aligned parallel to said shaft and slightly above a surface of said hair curling member for movement over a segment of the curl formed about said hair curling member, parallel and adjacent to the scalp for placement out of sight in the hair style.

2. The hair curling and styling tool of claim 1 wherein said handle member is hexagonal in cross section.

3. The hair curling and styling tool of claim 1 wherein said hair curling member is oval in cross-section to permit tighter curls to be made while simultaneously maximizing the length of said brush bristles.

4. The hair curling and styling tool of claim 1 wherein said hair brush comprises a plurality of rows of bristles of terminal length of constant diameter and of different lengths located in staggered arrangement for aiding in retaining the hair against said surface of said hair curling member when the tool is rotated to form the curl thereabout.

5. The hair curling and styling tool of claim 4 further including flat surfaces formed at said terminal ends of said bristles and having a rounded circumferential perimeter to reduce irritation caused by passing said bristles against the scalp.

6. The hair curling and styling tool of claim 1 wherein said offset portion of said hair fastener is terminated by a fitting and said means for temporarily holding said hair fastener includes an enlargement formed therein to receive said fitting in restrained position therein.

7. The hair curling and styling tool of claim 1 wherein said hair brush extends the full length of said hair curling member.

8. The hair curling and styling tool of claim 1 wherein said hair brush is formed parallel to the longitudinal axis of said straight shaft.

9. The hair curling and styling tool of claim 1 further including a guard extending about said hair curling member and slidingly mounted between said hair curling member and said handle member portion for sliding against the curl formed about said hair curling member to aid in withdrawing said tool from said formed curl.

10. The hair curling and styling tool of claim 1 wherein said brush includes:

a) a brush base positioned under the surface of said hair curling member, adapted for reciprocal movement in said shaft; and, b) a plurality of bristles in staggered arrangement directed upward from said base through apertures formed in said hair curling member and terminating above said surface thereof;

c) wherein said bristles are of constant diameter and of various lengths to aid in grasping the hair as it is curled about said hair curling member.

11. The hair curling and styling tool of claim 1 further including a hair separator extending from said handle member for separating the hair into segments to be curled.

12. A hair curling and styling tool comprising:

a) a straight hollow shaft having first and second opposed ends;

b) a handle member extending inward from said first end along said shaft;

c) a hair curling member extending inward from said second end toward said handle member, said handle member and said hair curling member separated by a circumferential ridge extending outwardly thereabout;

d) a hair brush including a plurality of brush bristles of terminal length carried in said shaft and extending substantially the full length of said hair curling member, and further including a plurality of apertures formed in said hair curling member through which said bristles protrude when in an operable position on said hair curling member;

e) means including a spring located in said shaft for biasing said brush from an operative position where said bristles extend outward from said hair curling member to an inoperative position interior said shaft and a trigger for moving said hair brush inside said shaft and out of contact with a curl formed thereabout;

f) means for temporarily mounting a U-shaped hair fastener axially outward from said shaft second end, said hair fastener including first and second shanks of terminal length, said first shank including a straight portion; said second shank having formed therein at least one sinusoidal curve, said shanks held together by a U-shaped connecting section, and an offset portion formed in said second shank terminated by a fitting formed thereon, said holding means including means for positioning said offset portion of said fastener such that said straight shank is aligned parallel to said shaft and slightly above a surface of said hair curling member for movement over a segment of the curl, formed about said hair curling member, parallel and adjacent to the scalp for placement out of sight in the hair style;

g) said means for temporarily mounting said U-shaped hair fastener including a pair of upper and lower walls extending from said shaft second end outwardly parallel to the axis of said shaft and separated by a slot formed therebetween of a thickness no greater than the thickness of said first shank; and, h) a cavity formed at the base of said slot for receipt therein of said fitting.

13. The hair curling and styling tool of claim 12 wherein said handle member is hexagonal in cross section.

14. The hair curling and styling tool of claim 12 wherein said hair curling member is oval in cross-section to permit tighter curls to be made while simultaneously maximizing the length of said brush bristles.

15. The hair curling and styling tool of claim 12 wherein said hair brush comprises a plurality of rows of bristles of constant diameter and of different lengths arranged in staggered arrangement for aiding in retaining the hair against said surface of said hair curling member when the tool is rotated to form the curl thereabout.

16. The hair curling and styling tool of claim 15 further including a flat surface formed at the terminal ends of said bristles and having a rounded circumferential perimeter to reduce irritation caused by passing said bristles over the scalp.

17. The hair curling and styling tool of claim 15 further including a hair separator extending from said handle member for separating the hair into segments to be curled.

18. The hair curling and styling tool of claim 12 further including a guard extending about said hair curling member and slidingly mounted between said hair curling member and said handle member for sliding against the curl formed about said hair curling member to aid in withdrawing said tool from said formed curl.

19. A hair curling and styling tool comprising:

a) a straight hollow shaft having first and second opposed ends and having a fine grained finish to aid in releasing hair formed thereabout;

b) a handle member having a hexagonal cross-section extending inward from said first end along said shaft and further including a short conical-shaped hair separator extending axially from said handle member for separating the hair into segments to be curled;

c) a hair curling member extending inward from said second end toward said handle member, said handle member and said hair curling member separated by an outwardly extending circumferential ridge;

d) a hair brush including a plurality of brush bristles carried on a base located in said shaft and extending substantially the full length of said hair curling member, and further including a plurality of apertures formed in said hair curling member through which said bristles protrude when in an operable position on said hair curling member;

e) said hair brush bristles further comprising a plurality of rows of bristles of terminal length of constant diameter and of different lengths located in staggered arrangement for aiding in retaining the hair against a surface of said hair curling member when the tool is rotated to form the curl thereabout and a flat surface formed at said terminal ends of said bristles and having a rounded circumferential perimeter to reduce irritation caused by passing said bristles against the scalp;

f) means including an arm pivotally mounted between said brush base and a wall formed in said handle member and a spring located in said shaft for biasing said arm against said brush base to bias said brush in an operative position where said bristles extend outward from and above said hair curling member to an inoperative position interior said shaft and a trigger for moving said hair brush inside said shaft and out of contact with a curl formed thereabout;

g) means for temporarily mounting a U-shaped hair fastener axially outward from said shaft second end, said hair fastener including first and second shanks of terminal length, said first shank including a straight portion; said second shank having formed therein at least one sinusoidal curve, said shanks held together by a U-shaped connecting section, and an offset portion formed in said second shank terminated by a fitting formed thereon, a depression formed in said first shank to partially receive a portion of said second shank caused by the overbending of said U-shaped connecting section, said holding means including means for positioning said offset portion of said fastener such that said straight shank is aligned parallel to said shaft and slightly above said surface of said hair curling member for movement over a segment of the curl, formed about said hair curling member, parallel and adjacent to the scalp for placement out of sight in the hair style;

h) said means including a pair of upper and lower walls extending from said shaft second end outwardly parallel to the axis of said shaft and separated by a slot formed therebetween, of a thickness no greater than the thickness of said first shank and a pair of sidewalls extending from said upper and lower walls to stabilize said first shank therebetween; and, i) a cavity formed at the base of said slot for receipt therein of said fitting.

20. The hair curling and styling tool of claim 19 further including a guard extending about said hair curling member and slidingly mounted between said member and said handle for sliding against the curl formed about said hair curling member to aid in withdrawing said tool from said formed curl, said guard having an inside surface conforming to the cross-sectional shape of said hair curling member and an outer perimeter in a polygonal shape to prevent said tool from rolling off of a level surface.

* * * * *